US006822791B2

(12) United States Patent
Recknagel

(10) Patent No.: US 6,822,791 B2
(45) Date of Patent: Nov. 23, 2004

(54) MOUNTING DEVICE FOR A TELESCOPE

(76) Inventor: Georg Christian Recknagel, Bertha-von-Suttner-Str. 12, 97421 Schweinfurt (DE)

( * ) Notice: Subject to any disclaimer, the term of this patent is extended or adjusted under 35 U.S.C. 154(b) by 0 days.

(21) Appl. No.: 10/397,149

(22) Filed: Mar. 26, 2003

(65) Prior Publication Data

US 2004/0190135 A1 Sep. 30, 2004

(30) Foreign Application Priority Data

Apr. 5, 2002 (DE) ..... 102 15 105

(51) Int. Cl.[7] ..... G02B 23/08; F41C 3/14

(52) U.S. Cl. ..... 359/405; 359/399; 359/819; 42/124; 42/127

(58) Field of Search ..... 359/399–425, 359/808–819; 42/121–147, 75; D22/108–110

(56) References Cited

U.S. PATENT DOCUMENTS 4,291,476 A * 9/1981 Repa ..... 42/124
4,509,282 A * 4/1985 McMillon ..... 42/124
6,598,333 B1 * 7/2003 Randazzo et al. ..... 42/127
6,678,988 B1 * 1/2004 Poff, Jr. ..... 42/147

FOREIGN PATENT DOCUMENTS

DE 4133242 * 10/1992 ..... 359/405
FR 2283418 * 3/1976 ..... 359/405

OTHER PUBLICATIONS

English abstract and one sheet of figure of the Korean reference KR2001069661, published on Jul. 25, 2001.*

* cited by examiner

*Primary Examiner*—Thong Q Nguyen

(57) ABSTRACT

The present invention provides a mounting device for a telescope fixed on a firearm by means of a telescope rail connected to the body of the telescope and a mount rail to be engaged into the telescope rail, said telescope rail centrically comprising a multitude of taped boreholes.

19 Claims, 4 Drawing Sheets

MOUNTING DEVICE FOR A TELESCOPE

FIELD OF THE INVENTION

The present invention discloses a mounting device for a telescope fixed on a firearm by means of a telescope rail connected to the body of the telescope and a mount rail to be engaged into the scope rail.

BACKGROUND OF THE INVENTION

The German utility model G 90 06 133.0 U1 describes a telescope mount to be removably fixed on a rifle at two determined points with a rigid and a movable fixing element, wherein the telescope mount consists of a longish basic part to which both the rigid element and the movable fixing element are connected.

The German patent DE 38 20 471 C2 describes a mounting device for a telescope with a trapezoidally shaped rail which is connected with the body of the telescope, the shorter part of which is situated in a correspondingly shaped intermediary with a certain clearance, the connection being realised by at least one fixing device at the intermediary, while a groove is milled into the rail and a clamp is inserted into the groove, the shape of which corresponds with the shape of the groove, and the fixing device is situated between the intermediary and the clamp.

In the prior art described above it is considered disadvantageous that the mounting device requires several fixtures and a so-called "blind installation" is necessary, which means that the taped boreholes of the fixtures have to be searched.

SUMMARY OF THE INVENTION

It is an object of the present invention to overcome the aforementioned disadvantages of the prior art and thus to shorten the time needed for mounting the telescope.

According to the invention the object is solved by a mounting device for a telescope fixed on a firearm by means of a telescope rail connected to the body of the telescope and a mount rail to be engaged into the telescope rail, wherein said telescope rail centrically comprises a multitude of taped boreholes.

In a preferred embodiment said telescope rail of the mounting device is provided with a triangular, a round, a trapezoidal, a rectangular, a perforated, a convex or a concave profile.

The telescope rail may be provided with several profiles as well.

It is particularly preferred if both the telescope rail and the mount rail, are provided with a triangular profile.

The telescope rail and the mount rail are prepared for receiving telescope mounts composed of one, two or more parts in order to be mounted on hunting or sporting rifles.

A wide triangular profile does not allow a lateral disalignement so that the pin of the telescope is always in a vertical position in order to predetermine the distance.

In a further preferred embodiment the taped boreholes of the telescope rail are equidistant.

Due to the direct connection between the telescope and the mount rail by means of hexagonal socket screws a compact, frictional connection is realized both in horizontal and vertical direction. A particular advantage is that no further fixing elements are needed. By the mounting device according to the invention the so-called "blind installation" of the prior art, which means that the taped boreholes of the fixing elements have to be searched, is no longer necessary.

The hexagonal socket screws together with the multitude of taped boreholes enable multiple displacement of the telescope in longitudinal direction. The liberated power being effective in longitudinal direction by firing off the gun is simultaneously cushioned and stopped by the hexagonal socket screws which are pressed closely into the counterbored holes. A displacement or moving of the telescope, which occurs very often with big telescopes, is no longer possible with the mounting device according to the invention, which has to be considered as a further advantage.

The connection of the telescope/telescope rail with the mount rail as counterpart to said telescope rail allows an extremely low and harmonious design which can be considered as a further advantage of the mounting device according to the invention.

The profile allows the use of aluminum. Further, for fixing no additional steel parts are needed. For the aforementioned reasons the mounting device according to the invention has a very low weight.

Further a mounting device is particularly preferred wherein on one or both sides said telescope rail is provided with a scale and said mount rail with a fixing point.

As it pertains to the graduation, a scale of any desired width is provided on the telescope rail. Every single position of the scale may be milled and for better visibility the scale may be colored and provided with arabic figures. The mount rail is accordingly provided with a single indicator line, a so-called fixing point, which may be brought into the desired position on the mentioned scale.

Based on a positioning paper, previously prepared and delivered, it is now possible for the first time that the desired eye distance for a rifle X and a telescope Y is reached on the scale with i.e. eleven figures at a determined position. If another eye distance is desired, this will be reached by just shifting the position of the telescope rail against the position of the mount rail by i.e. one taped borehole. Thus an adaptation to the eye of the shooter can be carried out easily without measuring.

Summarizing it can be stated that the mounting device according to the invention is extremely easy to use and requires very little working time for mounting the telescope.

BRIEF DESCRIPTION OF THE DRAWINGS

In the following, the present invention will be exemplarily described by means of the drawings. It shows FIG. 1 a side view of a telescope mount installed according to the invention on a gun barrel, FIG. 2 in a view from below the telescope rail and the telescope, FIG. 3 a side view of the telescope rail and the telescope, FIG. 4 a top view of the mount rail, and FIG. 5 in a sectional view of FIG. 1, the telescope with telescope rail and mount rail.

DETAILED DESCRIPTION OF THE DRAWINGS

Figure 3:
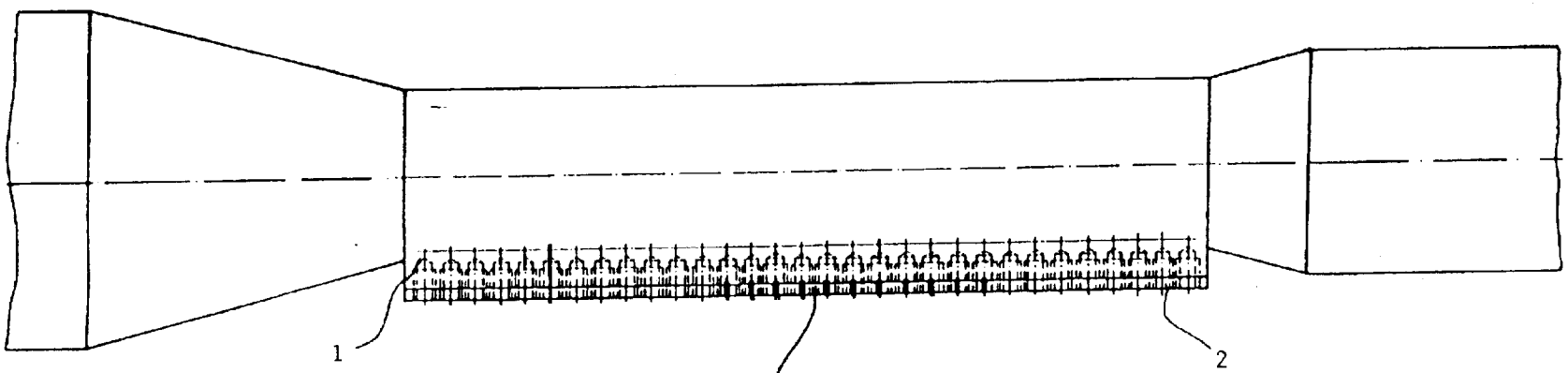

At the bottom of the telescope consisting of objective 4, middle tube 5 and eyepiece 6 the telescope rail 1 is arranged, which may be provided with a scale with identification FIG. 3. The telescope rail 1 is centrically provided with a multitude of taped boreholes 2. For reasons of clarity in FIG. 1 only a few boreholes 2 are shown. The distance between the respective taped boreholes can be chosen freely, however, a distance of 4.5 mm is considered as particularly advantageous for handling.

An exemplary triangular profile 7 of the telescope rail 1 fits to the triangular profile 16 of the mount rail 8. The latter shows a fixing point 9 on its side. The distance between two scale positions is provided in a way that, when shifting the telescope rail 1 by one borehole against the position of the mount rail 8, the position of the scale is changed by one figure. Thus the fixing point 9 always coincides with a figure on the scale.

Further the mount rail 8 shows connecting screws 11, a pivot 12, a locking part 13 and a spacer 14. The fixing screws 15 provide a frictional connection between the mount rail 8 and the telescope rail 1. The mount rail 8 is connected with the gun barrel 21 by the front base 17 and the rear base 18 by the screws 19 of the front base and the screws 20 of the rear base, respectively.

Figure 2:
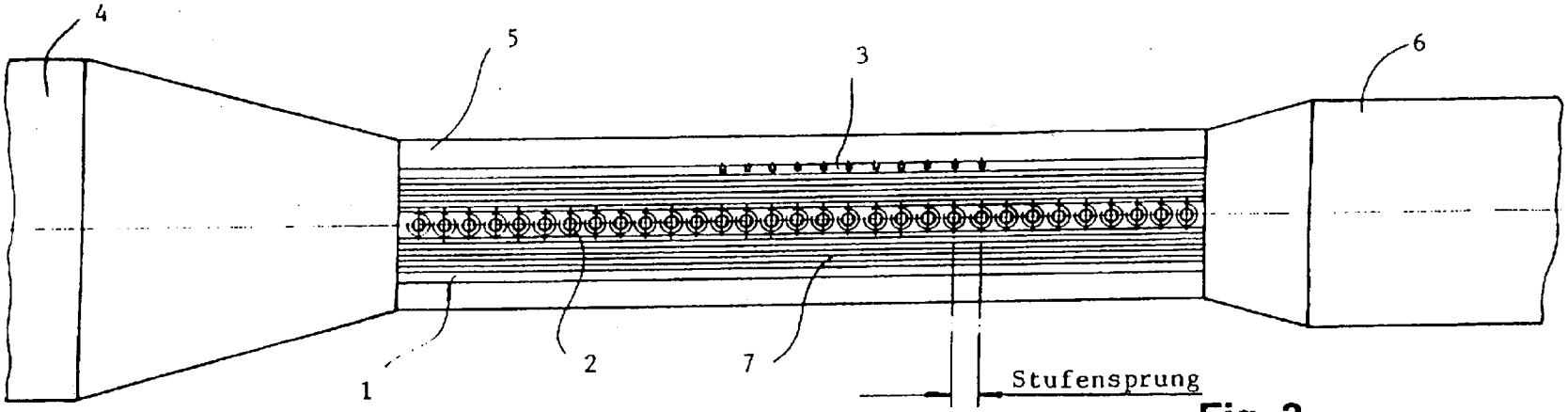

FIG. 2 shows the equidistant distance of the taped boreholes 2 emphasizing the distance as a progressive step.

Figure 4:
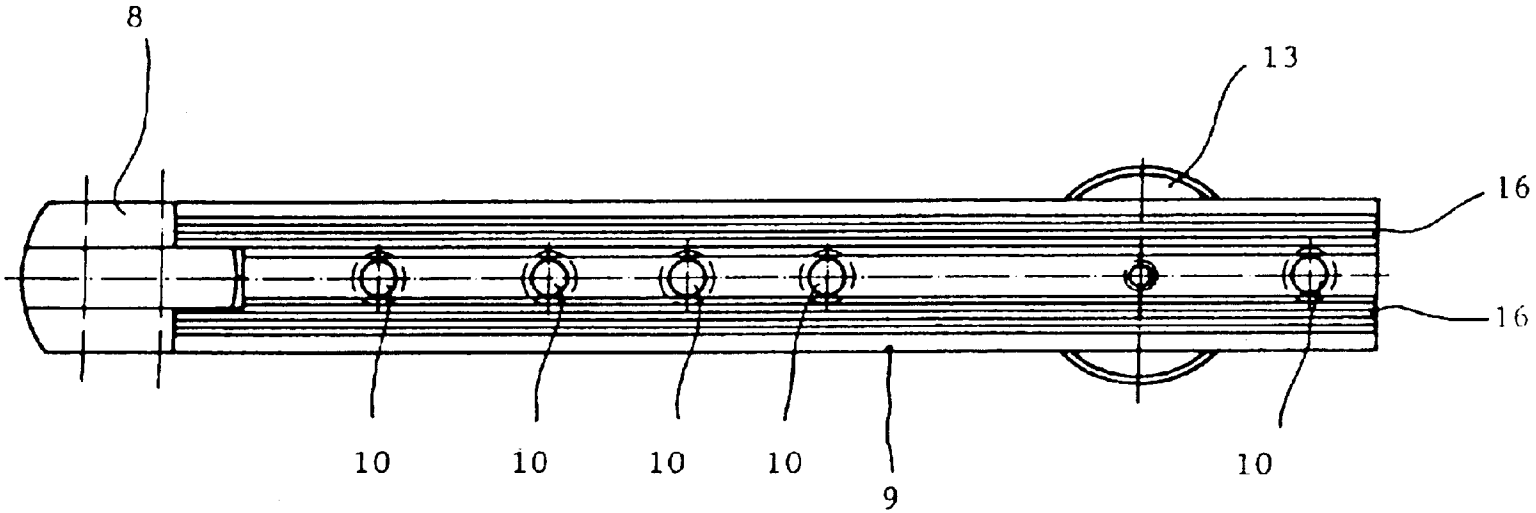

FIG. 4 shows the counterbored holes 10 for the fixing screws 15 as well as the arrangement of the profiles of the mount rail 8.

Figure 1:
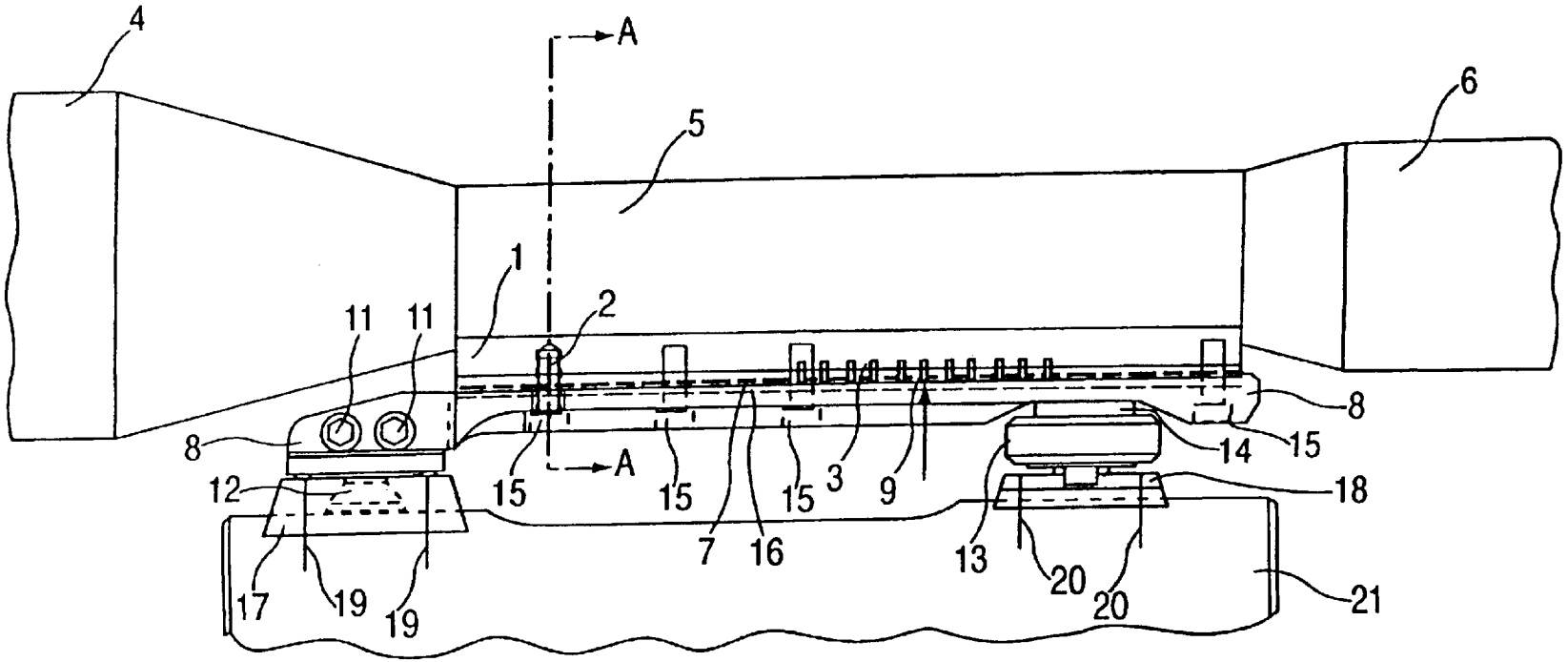
Figure 5:
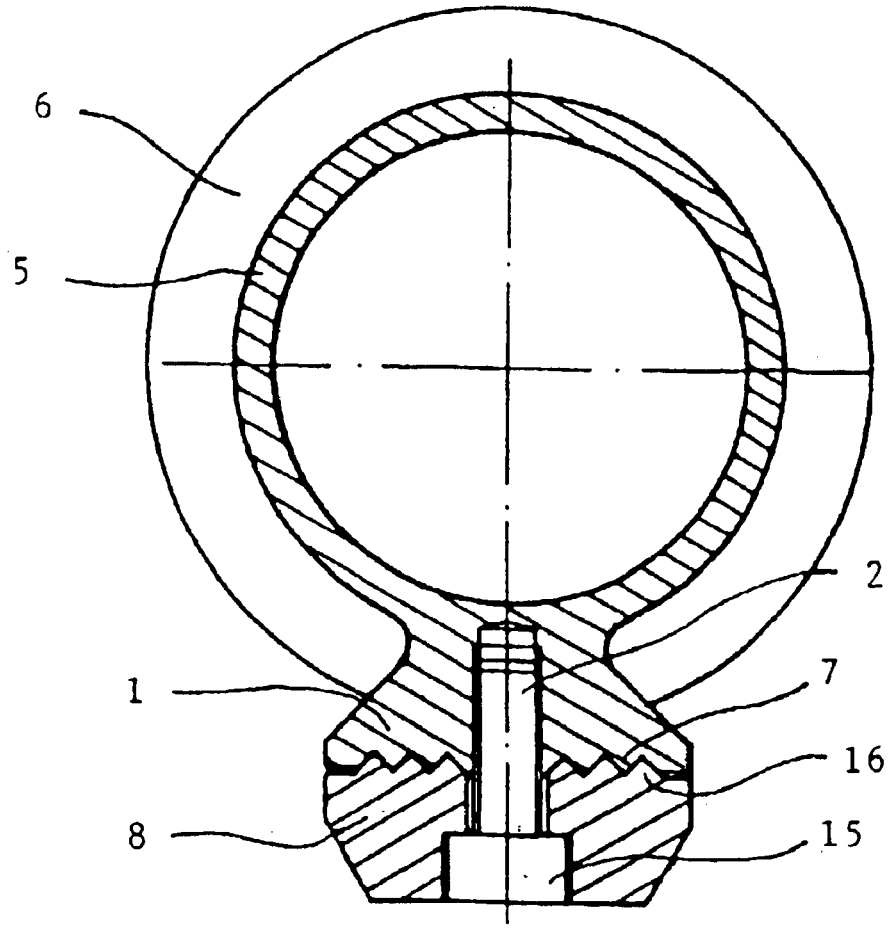

FIG. 5 the sectional view A—A of FIG. 1. This view emphasizes particularly the toothing of the telescope rail 1 into the mount rail 8 and the fastening of both rails by means of the fixing screws 15.

List of Reference Numbers

1 telescope rail
2 taped borehole
3 scale with identification figures
4 objective
5 middle tube
6 eyepiece
7 triangular profile of the telescope rail
8 mount rail
9 fixing point
10 counterbored hole for fixing screw
11 connecting screw
12 pivot
13 locking part
14 spacer
15 fixing screw
16 triangular profile of the mount rail
17 front base
18 rear base
19 screw of front base
20 screw of rear base
21 gun barrel

What is claimed is:

1. Mounting device for a telescope fixed on a firearm by means of a telescope rail connected to the body of the telescope and a mount rail to be engaged into the telescope rail, said telescope rail centrically comprising a multitude of taped boreholes.

2. Mounting device as in claim 1, wherein said telescope rail is provided with a triangular, a round, a trapezoidal, a rectangular, a perforated, a convex or a concave profile.

3. Mounting device as in claim 2, wherein said telescope rail and said mount rail are provided with a triangular profile.

4. Mounting device as in claim 3, wherein said taped boreholes are equidistant.

5. Mounting device as in claim 3, wherein on one or both sides said telescope rail is provided with a scale and said mount rail with a fixing point.

6. Telescope rail as in claim 3.

7. Mount rail as in claim 3.

8. Mounting device as in claim 2, wherein said taped boreholes are equidistant.

9. Mount rail as in claim 8.

10. Mounting device as in claim 2, wherein, on one or both sides said telescope rail is provided with a scale and said mount rail with a fixing point.

11. Telescope rail as in claim 2.

12. Mounting device as in claim 1, wherein said taped boreholes are equidistant.

13. Mounting device as in claim 12, wherein on one or both sides said telescope rail is provided with a scale and said mount rail with a fixing point.

14. Mounting device as in claim 1, wherein on one or both sides, said telescope rail is provided with a scale and said mount rail with a fixing point.

15. Telescope as in claim 1.

16. Mounting device for a telescope on a firearm by means of a telescope rail connected to the body of the telescope and a mount rail engaged into the telescope rail, said telescope rail centrically comprising a multitude of taped boreholes and wherein said telescope rail is provided with a triangular, a round, a trapezoidal, a rectangular, a perforated, a convex, or a convex profile, or more than one of said profiles.

17. Mounting device as in claim 3, wherein said taped boreholes are equidistant.

18. Mounting device as in claim 3, wherein on one or both sides said telescope rail is provided with a scale and said mount rail with a fixing point.

19. Telescope rail as in claim 16.

* * * * *